US006952185B1

(12) United States Patent
Ryken Jr. et al.

(10) Patent No.: US 6,952,185 B1
(45) Date of Patent: Oct. 4, 2005

(54) METHOD FOR MANUFACTURING AND TUNING THE CENTER FREQUENCY OF A MICROSTRIP ANTENNA

(75) Inventors: Marvin Ryken Jr., Oxnard, CA (US); Rick Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 28 days.

(21) Appl. No.: 10/868,443

(22) Filed: Jun. 9, 2004

Related U.S. Application Data

(63) Continuation of application No. 10/795,096, filed on Feb. 26, 2004.

(51) Int. Cl.[7] ..... H01Q 1/38

(52) U.S. Cl. ..... 343/700 MS; 343/846; 343/705

(58) Field of Search ..... 343/700 MS, 702, 343/846, 848, 705; H01Q 1/38

(56) References Cited

U.S. PATENT DOCUMENTS

| | | | | | |
|---|---|---|---|---|---|
| 5,245,745 | A | * | 9/1993 | Jensen et al. | 29/600 |
| 5,408,241 | A | * | 4/1995 | Shattuck et al. | 343/700 MS |
| 5,467,095 | A | * | 11/1995 | Rodal et al. | 343/700 MS |
| 6,225,959 | B1 | * | 5/2001 | Gordon | 343/769 |
| 6,597,318 | B1 | * | 7/2003 | Parsche et al. | 343/700 MS |
| 6,842,145 | B1 | * | 1/2005 | Ryken et al. | 343/700 MS |

* cited by examiner

*Primary Examiner*—Hoanganh Le
(74) *Attorney, Agent, or Firm*—David S. Kalmbaugh

(57) ABSTRACT

A method for fine tuning a microstrip antenna which has eight tuning tabs for tuning the antenna frequency of the microstrip antenna. The antenna is designed to operate around 430 MHz with a tuning step size of approximately 1.5 MHz. The method utilizes the eight tuning tabs to tune the antenna from a center frequency of 427.2 MHz when all eight tuning tabs are connected to the cooper radiating or antenna element of the antenna incrementally to a center frequency of 439.3768 MHz when the eight tuning tabs are disconnected from the cooper antenna element.

21 Claims, 5 Drawing Sheets

METHOD FOR MANUFACTURING AND TUNING THE CENTER FREQUENCY OF A MICROSTRIP ANTENNA

This application is a continuation of U.S. patent application Ser. No. 10/795,096, filed Feb. 26, 2004, now pending.

BACKGROUND OF THE INVENTION

1. Field of the Invention

The present invention relates generally to a microstrip antenna for use on a missile or the like. More specifically, the present invention relates to a method for manufacturing and tuning the center frequency of a microstrip antenna which includes a plurality of tuning tabs for tuning the center frequency of the microstrip antenna.

2. Description of the Prior Art.

A microstrip antenna operates by resonating at a frequency. Conventional design techniques for a microstrip antenna use printed circuit technology to place a printed copper patch on the top of a layer of a dielectric and a ground plane on the bottom of the dielectric. The frequency that a microstrip antenna operates at is approximately a half wavelength or a quarter wavelength with one side grounded in the microstrip medium of dielectric below the copper patch and air above the copper patch. On high performance projectiles (e.g. missiles), a protective dielectric cover is used to protect the antenna from the environment.

Without a protective cover, a portion of the microstrip antenna can be removed to tune the microstrip antenna up in frequency. When there is a cover to protect the microstrip antenna, the microstrip antenna is normally tuned by using tuning slugs which are screwed in an upward direction from the ground plane of the antenna toward the microstrip antenna's copper patch. As the slug is tuned toward the microstrip antenna, there is an increase in capacitance which lowers the operating frequency of the microstrip antenna.

For low frequency operation, the usual amount of space available for the microstrip antenna dictates a very narrow frequency bandwidth.

Further, due to manufacturing tolerances, there is need for a tuning apparatus for tuning the antenna frequency which achieves an acceptable failure rate for antennas in production.

SUMMARY OF THE INVENTION

The present invention overcomes some of the disadvantages of the past including those mentioned above in that it comprises a method for manufacturing and tuning the center frequency of a microstrip antenna which includes eight tuning tabs for tuning the center frequency of the microstrip antenna. The antenna is designed to operate around 430 MHz with a tuning step size of approximately 1.5 MHz. The method of the present invention utilizes eight tuning tabs which allow the antenna to be tuned from a center frequency of 427.2 MHz when all eight tuning tabs are connected to the cooper radiating or antenna element of the antenna incrementally to a center frequency of 439.3768 MHz when the eight tuning tabs are disconnected from the cooper antenna element. Tuning tab vias are provided to electrically connect each tuning tab to the copper radiating patch. Drilling out the tuning tab vias one at a time, electrically disconnects each of the tuning tabs from the copper radiating patch, fine tunes the center frequency for the microstrip antenna.

The antenna functions as a quarter wavelength, one side grounded microstrip antenna. The antenna polarization is linear and there is a three sided gap around the antenna element with the antenna's electric field being confined primarily to the gap.

DETAILED DESCRIPTION OF THE PREFERRED EMBODIMENT

Figure 5:
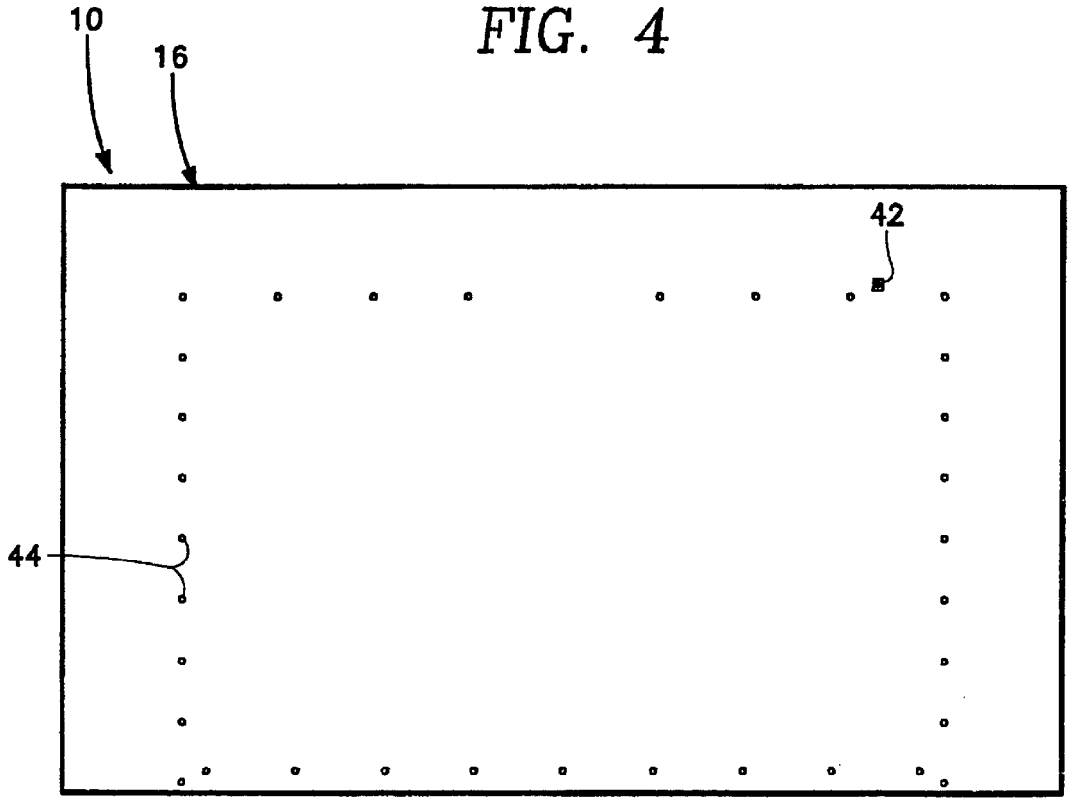
FIG. 5 illustrates a ground board for the microstrip antenna of FIG. 1 which includes vias, plated through holes with pads on the top of the board and solid copper on the bottom of the board.

Referring to FIGS. 1–5, the microstrip antenna 10 comprising the preferred embodiment of the present invention is composed of three printed circuit boards stacked on one another. The three printed circuit boards includes cover board 14 (FIG. 4), a circuit board 12 (FIGS. 1, 2A and 3), and a ground board 16 (FIG. 5). Both the circuit board 12 and the ground board 16 are made from Rogers Corporation's Duriod 6002 and each board 12 and 16 has a thickness of 0.045 inches. Roger's Duriod 6002 is a high frequency circuit board laminate material used in microwave/radio frequency circuit boards and is commercially available from Rogers Corporation of Rogers, Connecticut. The cover board 14 is made from Rogers Corporation's Duriod 5870 and has a thickness of 0.155 inches. Each board 12, 14 and 16 has overall dimensions of 8.125 inches in length and 5.00 inches in width. A one ounce copper plating is etched off the circuit board 12 and the ground board 16 with the patterns for these boards depicted in FIGS. 1, 2A, 3 and 5.

Microstrip antenna 10 is designed to operate at a frequency of approximately 430 MHz with a tuning step size of approximately 1.5 MHz. Microstrip antenna 10 is designed to operate with linear polarization, although circular polarization of the antenna can be accommodated by providing tuning tabs on two adjacent sides of the antenna. To minimize the area required by antenna 10, microstrip antenna 10 was designed as a quarter wavelength, one side grounded microstrip antenna.

The following written description sets forth the principle of operation for the microstrip antenna 10 comprising the present invention. When a small copper area, which is a tuning tab is placed on an inner layer of a microstrip antenna and in close proximity to the end of the microstrip antenna, the tuning tab will lower the frequency of the microstrip antenna when the tuning tab is connected to the antenna or to the ground plane 47 below the antenna. This frequency change is caused by the added capacitance of the tuning tab that is coupled to the microstrip antenna. Removing the connection of the tuning tab to the copper patch or the ground plane 47 reduces capacitance resulting in an increase in the operating frequency of the microstrip antenna. When multiple tuning tabs are utilized with a microstrip antenna, each with its own connection, multiple small frequency steps are provided or increments are provided for tuning the antenna frequency.

Referring to FIGS. 1, 2A, 2B and 3, microstrip antenna 10 is designed to operate at approximately 430 MHz with a tuning step size of approximately 1.5 MHz while utilizing eight tuning tabs 18, 20, 22, 24, 26, 28, 30 and 32 to fine tune the operating frequency of microstrip antenna 10. Each of the eight tuning tabs 18, 20, 22, 24, 26, 28, 30 and 32 are cooper shaped squares having dimensions of 0.201 inch by 0.201 inch.

The upper surface of circuit board 12 includes an antenna element 34 which is the copper radiating element for microstrip antenna 10. There is a three sided gap 36 around the antenna element 34 except for the grounded side 37 of the microstrip antenna. The antenna's electric field is confined primarily to the three sided gap 36. The gap has a width of approximately 0.015 inches. The copper region 38, which is a copper plating, around the antenna element 12 is maintained at a ground potential by a plurality of vias or copper plated through holes 44. Vias 44 pass through the dielectric substrate 35 of the circuit board 12 and the dielectric substrate of the ground board 16 to copper ground plane 47 on the bottom surface of ground board 16. The 33 vias 44 electrically connect the copper region 38 of circuit board 12 to the ground plane 47 of ground board 16.

The antenna element 34 has one end 39 of a feed 40, which is a copper transmission line mounted on the bottom surface of the circuit board 12, connected thereto. The opposite end 42 of the feed 40 is connected to an output connector, which is a SMA female stripline connector mounted on the bottom surface of the ground board 16.

Figure 3:
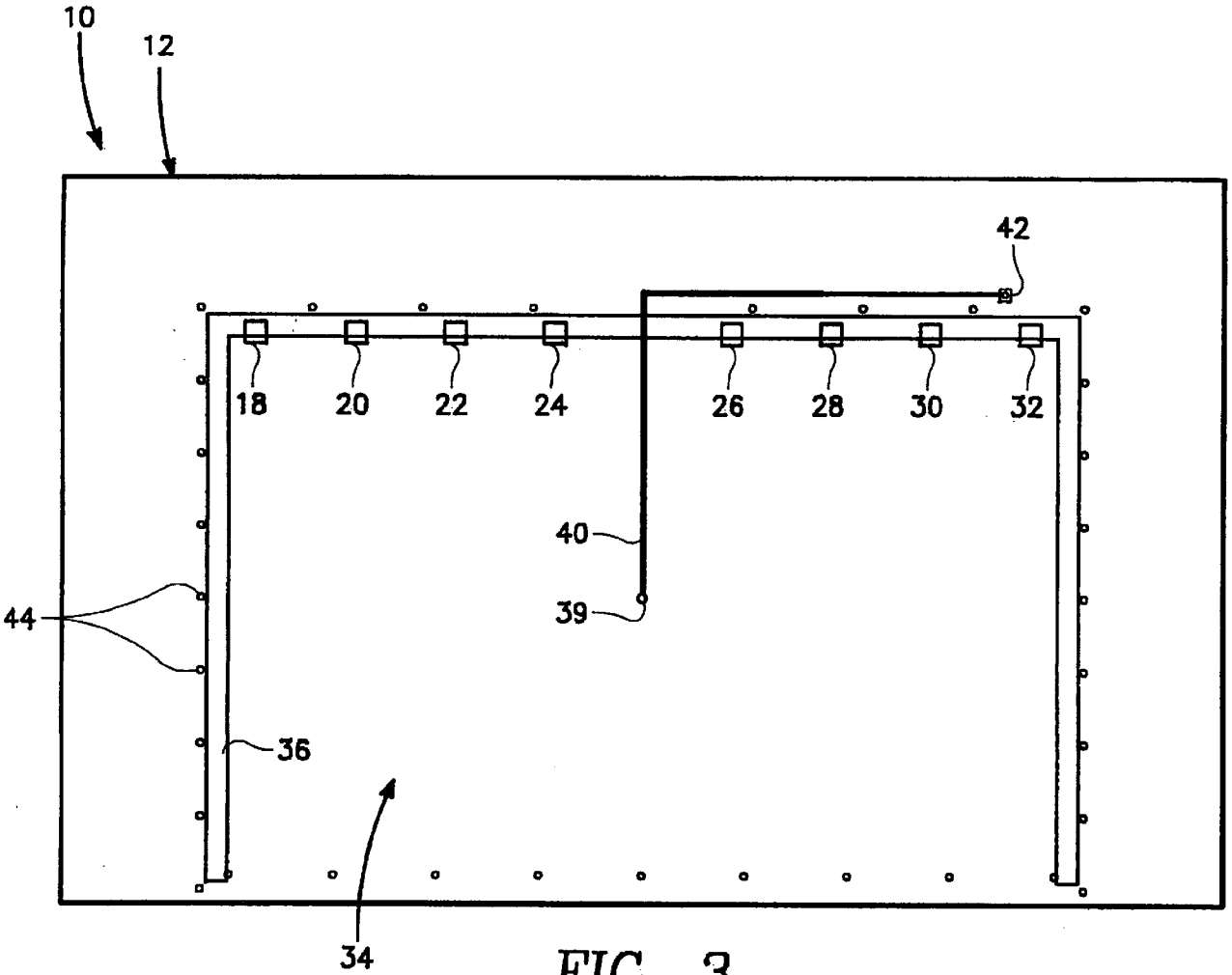
FIG. 3 illustrates a composite view of the top, bottom and middle layers of circuit board for the microstrip antenna of FIG. 1 which includes tuning tabs for tuning the antenna frequency.
Figure 4:
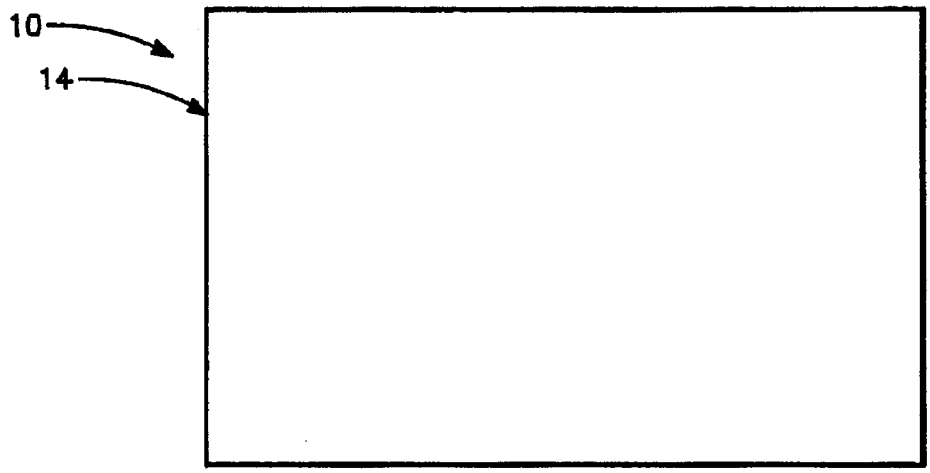
FIG. 4 illustrates a cover board for the microstrip antenna of FIG. 1 which includes tuning tabs for tuning the antenna frequency.

Referring to FIG. 3, FIG. 3 is composite view of the top and bottom surface of the circuit board 12 which shows the physical location of the antenna element 34 and gap 36 relative to the tuning tabs 18, 20, 22, 24, 26, 28, 30 and 32. It should be noted that the tuning tabs 1B, 20, 22, 24, 26, 28, 30 and 32 overlap the antenna element 34 and extend into the gap 36 between antenna element 34 and the grounded copper region 38. Each tuning tab is connected by a via to the antenna element 34 near the lower edge of the tuning tab below the gab 38.

Figure 1:
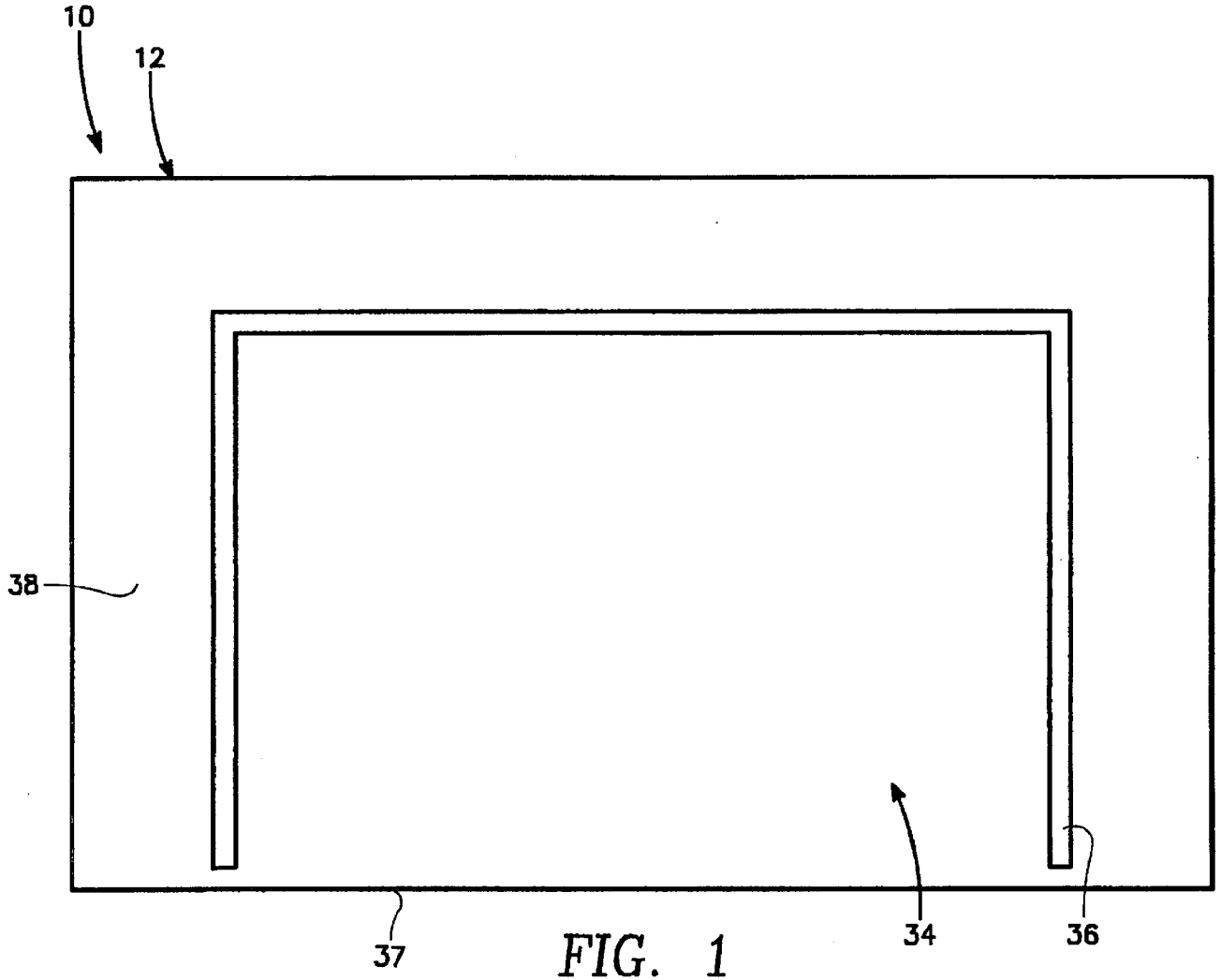
FIG. 1 illustrates a top layer of circuit board for the microstrip antenna which has tuning tabs for tuning the antenna frequency comprising the present invention.
Figure 2A:
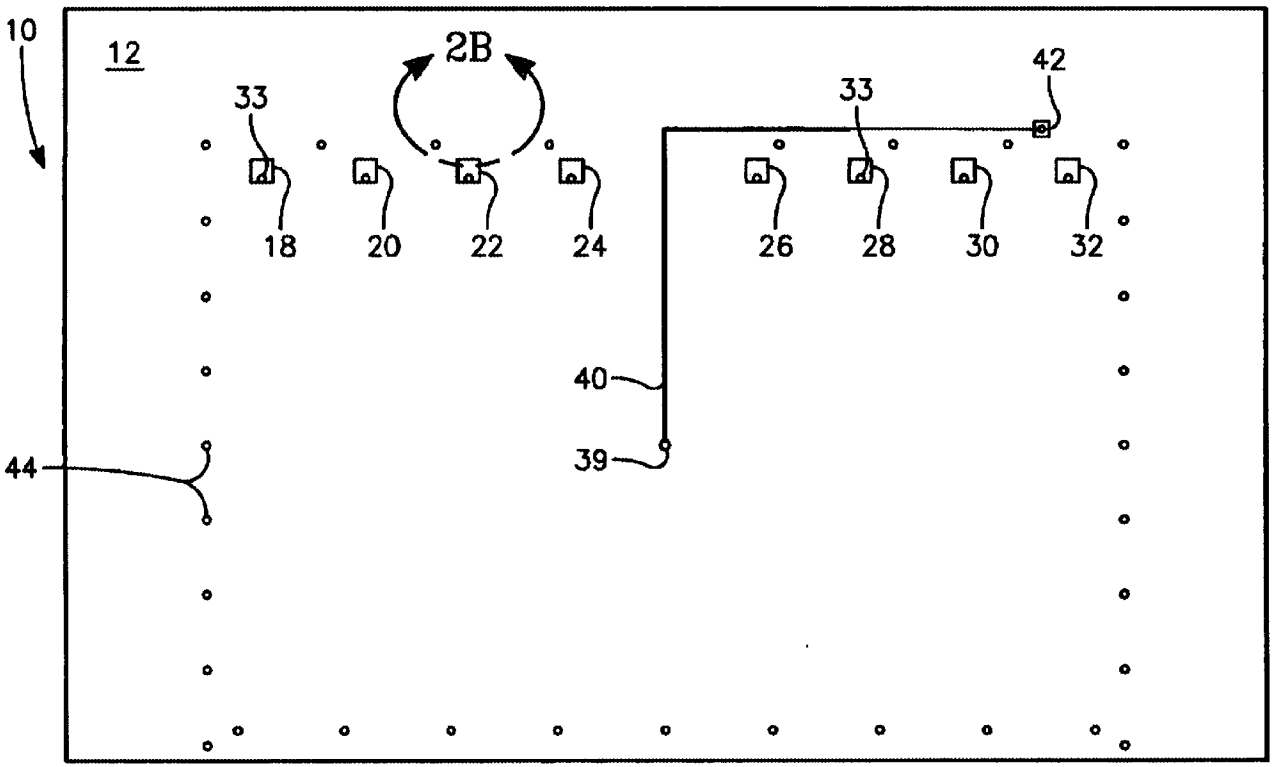
FIG. 2A illustrates a bottom layer of circuit board for the microstrip antenna of FIG. 1 which includes tuning tabs for tuning the antenna frequency.
Figure 2B:
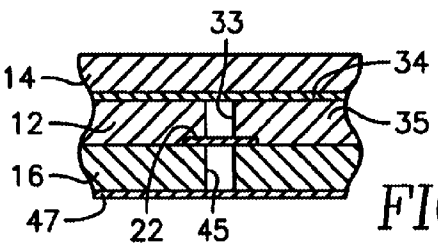
FIG. 2B illustrates a view of the circuit board taken along line 2B—2B of FIG. 2A.
Figure 6:
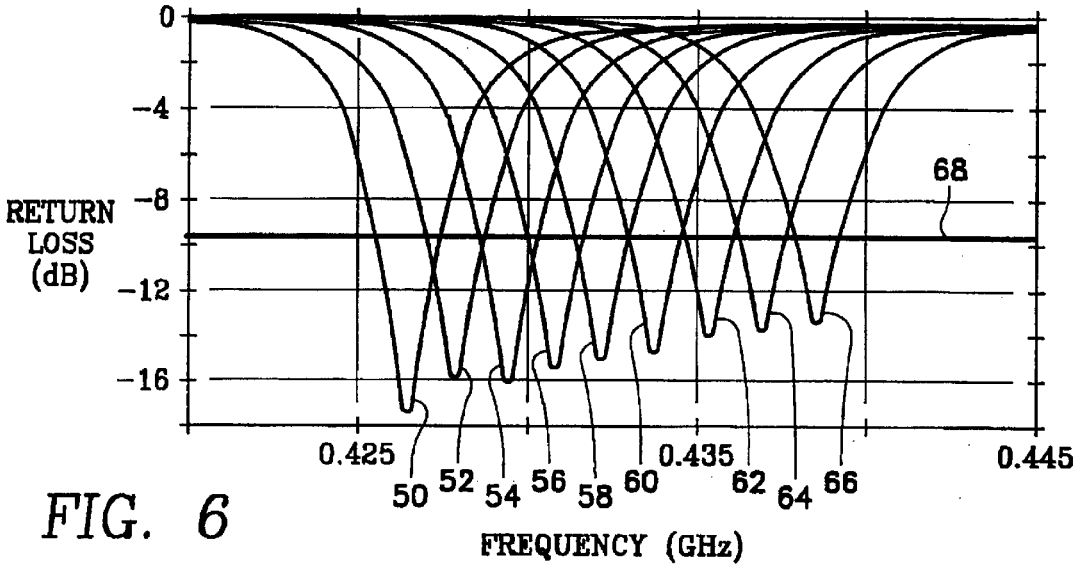
FIG. 6 is a frequency versus return loss plot for the microstrip antenna of FIG. 1 when the microstrip antenna includes from zero to eight tuning tabs.

The plot of FIG. 6 depicts return loss in decibels versus operating frequency. The return loss when tabs are removed from microstrip antenna 10 was measured to determine the operating frequency for microstrip antenna 10. Plot 50 depicts antenna 10 when all eight tabs are electrically connected to copper patch 34. Each of the tuning tabs 18, 20, 22, 24, 26, 28, 30 and 32 is electrically connected to the copper patch 34 by a via 33 which passes through the dielectric substrate 35 of circuit board 12 as is best depicted in FIG. 2B. By drilling out the tuning tab vias 33 one at a time, the return was loss was measured to determine the effect of each tuning tab 18, 20, 22, 24, 26, 28, 30 and 32 as the tuning tabs were disconnected from copper patch 34. The order of removal of the electrical connection between copper patch/antenna element 34 and the tuning tabs was tuning tab 18, tuning tab 32, tuning tab 20, tuning tab 30, tuning tab 22, tuning tab 28, tuning tab 24 and tuning tab 26.

Plot 52 depicts return loss when tuning tab 18 is disconnected from copper patch 34, plot 54 depicts return loss when tuning tabs 18 and 32 are disconnected from copper patch 34, plot 56 depicts return loss when tuning tabs 18, 20 and 32 are disconnected from copper patch 34, and plot 58 depicts return loss when tuning tabs 18, 20, 30 and 32 are disconnected from copper patch 34.

Plot 60 depicts return loss when tuning tabs 18, 20, 22, 30 and 32 are disconnected from copper patch 34, plot 62 depicts return loss when tuning tabs 18, 20, 22, 28, 30 and 32 are disconnected from copper patch 34, plot 64 depicts return loss when tuning tabs 18, 20, 22, 24, 28, 30 and 32 are disconnected from copper patch 34, and plot 62 depicts return loss when each of the eight tuning tabs 18, 20, 22, 24, 26, 28, 30 and 32 are disconnected from copper patch 34.

The center frequency for microstrip antenna 10 is defined as the peak of the return loss plot. The bandwidth for microstrip antenna 10 is defined as the frequency band at the intersection of a 2:1 VSWR (voltage standing wave ratio) line 68. The bandwidth for each of the plots 50, 52, 54, 56, 58, 60, 62 and 64 is consistent versus tuning tab removal and is approximately 1.5 MHz.

As shown in FIG. 6, tuning is smooth and tab position has minimal impact on the performance of the antenna. Since peak return loss decreases as tuning tabs are removed, the antenna match becomes less desirable but still within a reasonable operating range as depicted in FIG. 6.

Figure 7:
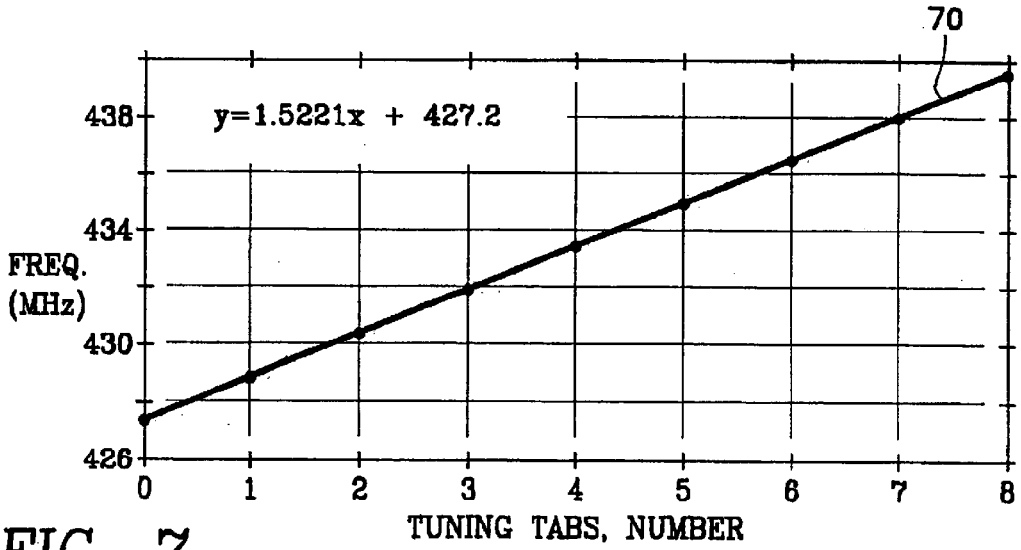
FIG. 7 is a plot illustrating the center frequency for the microstrip antenna of FIG. 1 versus number of tuning tabs when the microstrip antenna includes from zero to eight tuning tabs.

As shown in the plot 70 of FIG. 7, the center frequency of the microstrip antenna 10 can be adjusted by removing tuning tab vias 33. The center/operating frequency y for plot 70 is given by the following expression:

$$y=1.5221x+427.2$$

where x is the number of tuning tab vias removed from microstrip antenna 10 and y is the operating frequency for microstrip antenna 10. For example, when microstrip antenna 10 includes the eight tuning tabs 18, 20, 22, 24, 26, 28, 30 and 32, the operating frequency of the antenna is 427.2 MHz. When two of the eight tuning tab vias 33 are removed from microstrip antenna 10, the operating frequency is:

$$y=1.5221(2)+427.2=430.2442 \text{ MHz}$$

Similarly, when four of the eight tuning tab vias 33 are removed from the microstrip antenna 10, the operating frequency is:

$$y=1.5221(4)+427.2=433.2884 \text{ MHz}$$

When six of the eight tuning tab vias 33 are removed from the microstrip antenna 10, the operating frequency is:

$$y=1.5221(6)+427.2=436.3326 \text{ MHz}$$

When all eight of the eight tuning tab vias are removed from the microstrip antenna 10, the operating frequency is:

$$y=1.5221(8)+427.2=439.3768 \text{ MHz}$$

The microstrip antenna 10 comprising the present invention was fabricated in the following manner. Circuit board 12 and ground board 16 were bonded together at high temperatures and constant pressure. The bonding film was clear around the vias 44 and the vias 44 were tinned with solder. The bonding temperature is higher than the melting point of the solder such that when the vias 44 from the circuit board 12 are soldered to the vias 44 of the ground board 16 a continuous electrical path from the ground region 38 of circuit board 12 to the ground plane 47 on ground board 16 was created.

Referring to FIGS. 2B and 5, the tuning tab via holes 33 for the tuning tabs of microstrip antenna 10 were configured as pilot holes 45 in the ground board 16 (FIG. 2B) to drill through the ground board 16. These pilot holes 45 in the ground board 16 will be used to guide a drill to the cooper clad via holes 33 in the circuit board 12 for tuning the microstrip antenna 10.

The microstrip antenna 10 is composed of the three boards 12, 14 and 16 bonded together in the manner illustrated in FIG. 2B. After bonding the three boards 12, 14 and 16 together and attaching a connector to microstrip antenna 10, the return loss is measured and the center frequency for microstrip antenna 10 is determined. The required number of tabs to be disconnected is calculated and then the equivalent number of vias 33 are drilled out using the pilot holes 45 to guide a drill bit. This constitutes the tuning method for microstrip antenna 10.

From the foregoing, it is readily apparent that the present invention comprises a new, unique, and exceedingly useful microstrip antenna which includes tuning tabs for tuning the antenna frequency of the antenna, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A method for manufacturing and tuning a center frequency of a microstrip antenna comprising the steps of:

(a) providing a first dielectric layer having an upper surface and a lower surface;

(b) mounting a rectangular shaped copper antenna element on the upper surface of said first dielectric substrate, said antenna element generating an electric field;

(c) mounting a copper ground on a remaining portion of the upper surface of said first dielectric substrate (d) forming a continuous gap around an upper edge and two sides of said antenna element between said antenna element and said copper ground;

(e) mounting a plurality of aligned tuning tabs on the bottom surface of said first dielectric substrate, each of said tuning tabs being positioned on the bottom surface of said first dielectric substrate below the upper edge of said antenna element;

(F) mounting a plurality of tuning tabs vias within said first dielectric substrate, each of said tuning tab vias passing through said first dielectric substrate to connect one of said plurality of tuning tabs to said antenna element;

(f) positioning a second dielectric layer below said first dielectric layer in alignment with said first dielectric layer;

(g) mounting a ground plane on a bottom surface of said second dielectric layer;

(h) mounting a plurality of ground plane vias within said first dielectric layer and said second dielectric layer, each of the ground plane vias in said first dielectric layer being aligned with one of said ground plane vias in said second dielectric layer and connected thereto, said ground plane vias in said first dielectric layer and said second dielectric layer connecting said copper ground on said first dielectric layer to said ground plane on said second dielectric layer; and (i) tuning the operating frequency of said microstrip antenna by selectively removing said tuning tab vias from said first dielectric substrate wherein the operating frequency of said microstrip antenna is fine tuned by a predetermined incremental frequency when each of said tuning tab vias is removed from said first dielectric substrate.

2. The method of claim 1 further comprising the step of:

(a) mounting a copper transmission line on the bottom surface of said first dielectric layer; and (b) connecting one end of said copper transmission line to said antenna element and an opposite end of said copper transmission line to an external connector, said copper transmission line acting as signal feed for said microstrip antenna.

3. The method of claim 1 wherein the operating frequency for said microstrip antenna is approximately 430 MHz and the predetermined incremental frequency by which said microstrip antenna is fined tuned is approximately 1.5 MHz.

4. The method of claim 1 wherein said antenna element comprises a rectangular shaped copper patch.

5. The method of claim 1 wherein said first dielectric layer and said second dielectric layer each have a thickness of 0.045 inches.

6. The method of claim 1 wherein said first dielectric layer and said second dielectric layer each have an overall dimension of 8.125 inches in length and 5.00 inches in width.

7. The method of claim 1 further comprising the step of confining the electric field generated by said antenna element to said continuous gap wherein said continuous gap has a width of approximately 0.015 inches.

8. A method for manufacturing a microstrip antenna having an operating frequency which is tunable comprising:

(a) providing a first dielectric layer having an upper surface and a lower surface;

(b) mounting a rectangular shaped copper antenna element on the upper surface of said first dielectric substrate, said antenna element generating an electric field;

(c) mounting a copper ground on a remaining portion of the upper surface of said first dielectric substrate (d) forming a continuous gap around an upper edge and two sides of said antenna element between said antenna element and said copper ground;

(e) mounting eight aligned tuning tabs on the bottom surface of said first dielectric substrate;

(f) positioning each of said eight tuning tabs mounted on the bottom surface of said first dielectric substrate below the upper edge of said antenna element;

(g) mounting eight tuning tab vias within said first dielectric substrate, each of said eight tuning tab vias passing through said first dielectric substrate to connect one of said eight tuning tabs to said antenna element;

(h) positioning a second dielectric layer below said first dielectric layer in alignment with said first dielectric layer;

(i) mounting a ground plane on a bottom surface of said second dielectric layer;

(j) mounting a plurality of ground plane vias within said first dielectric layer and said second dielectric layer, each of the ground plane vias in said first dielectric layer being aligned with one of said ground plane vias in said second dielectric layer and connected thereto, said ground plane vias in said first dielectric layer and said second dielectric layer connecting said copper ground on said first dielectric layer to said ground plane on said second dielectric layer; and (k) tuning the operating frequency of said microstrip antenna by selectively removing said eight tuning tab vias from said first dielectric substrate wherein the operating frequency of said microstrip antenna is fine tuned by a predetermined incremental frequency of approximately 1.5 MHz when each of said eight tuning tab vias is removed from said first dielectric substrate.

9. The method of claim 8 further comprising the step of of positioning a third dielectric layer above said first dielectric layer in alignment with said first dielectric layer, said third dielectric layer providing a cover for said microstrip antenna.

10. The method of claim 9 wherein said first dielectric layer and said second dielectric layer each have a thickness of 0.045 inches, and said third dielectric layer has a thickness of 0.155 inches.

11. The method of claim 9 wherein said first dielectric layer, said second dielectric layer and said third dielectric layer each have an overall dimension of 8.125 inches in length and 5.00 inches in width.

12. The method of claim 8 further comprising the step of;

(a) mounting a copper transmission line on the bottom surface of said first dielectric layer; and (b) connecting one end of said copper transmission line to said antenna element and an opposite end of said copper transmission line to an external connector, said copper transmission line acting as signal feed for said microstrip antenna.

13. The method of claim 8 wherein the operating frequency for said microstrip antenna is approximately 430 MHz.

14. The method of claim 8 wherein said antenna element comprises a rectangular shaped copper patch.

15. The method of claim 8 further comprising the step of confining the electric field generated by said antenna element to said continuous gap wherein said continuous gap has a width of approximately 0.015 inches.

16. A method for manufacturing a microstrip antenna having a center frequency which is tunable comprising:

(a) providing a first dielectric layer having an upper surface and a lower surface;

(b) mounting a rectangular shaped copper antenna element on the upper surface of said first dielectric substrate, said antenna element generating an electric field;

(c) mounting a copper ground on a remaining portion of the upper surface of said first dielectric substrate (d) forming a continuous gap around an upper edge and two sides of said antenna element between said antenna element and said copper ground;

(e) mounting eight aligned tuning tabs on the bottom surface of said first dielectric substrate;

(f) positioning each of said eight tuning tabs mounted on. the bottom surface of said first dielectric substrate below the upper edge of said antenna element;

(g) mounting eight tuning tab vias within said first dielectric substrate, each of said eight tuning tab vias passing through said first dielectric substrate to connect one of said eight tuning tabs to said antenna element;

(h) positioning a second dielectric layer below said first dielectric layer in alignment with said first dielectric layer;

(i) mounting a ground plane on a bottom surface of said second dielectric layer;

(j) mounting a plurality of ground plane vias within said first dielectric layer and said second dielectric layer, each of the ground plane vias in said first dielectric layer being aligned with one of said ground plane vias in said second dielectric layer and connected thereto, said ground plane vias in said first dielectric layer and said second dielectric layer connecting said copper ground on said first dielectric layer to said ground plane on said second dielectric layer;

(k) tuning the center frequency of said microstrip antenna by selectively removing said eight tuning tab vias from said first dielectric substrate, wherein said center frequency is increased by removing said eight tuning tab vias from said first dielectric substrate in accordance with the following equation:

$$y=1.5221x+427.2$$

where x is the number of tuning tab vias removed from said microstrip antenna and y is the operating frequency for microstrip antenna; and (1) positioning a third dielectric layer above said first dielectric layer in alignment with said first dielectric layer, said third dielectric layer providing a cover for said microstrip antenna.

17. The method of claim 16 further comprising the step of:

(a) mounting a copper transmission line on the bottom surface of said first dielectric layer; and (b) connecting one end of said copper transmission line to said antenna element and an opposite end of said copper transmission line to an external connector, said copper transmission line acting as signal feed for said microstrip antenna.

18. The method of claim 16 wherein said antenna element comprises a rectangular shaped copper patch.

19. The method of claim 16 wherein said first dielectric layer and said second dielectric layer each have a thickness of 0.045 inches, and said third dielectric layer has a thickness of 0.155 inches.

20. The method of claim 16 wherein said first dielectric layer, said second dielectric layer and said third dielectric layer each have an overall dimension of 8.125 inches in length and 5.00 inches in width.

21. The method of claim 16 further comprising the step of confining the electric field generated by said antenna element to said continuous gap wherein said continuous gap has a width of approximately 0.015 inches.

* * * * *